United States Patent [19]

Carter

[11] 4,014,193

[45] Mar. 29, 1977

[54] LOCKING MECHANISM

[76] Inventor: Clinton L. Carter, 9510 E. Southport Road, Indianapolis, Ind. 46259

[22] Filed: Apr. 28, 1975

[21] Appl. No.: 572,152

Related U.S. Application Data

[63] Continuation-in-part of Ser. No. 494,080, Aug. 2, 1974, abandoned.

[52] U.S. Cl. ..... 70/288; 70/294; 70/312

[51] Int. Cl.[2] ..... E05B 37/16

[58] Field of Search ..... 70/287, 293, 301, 304, 70/294, 309, 311, 312, 315–318, 323, 329, 288; 292/150, 169

[56] References Cited

UNITED STATES PATENTS

| | | | |
|---|---|---|---|
| 158,811 | 1/1875 | Skinner | 292/150 X |
| 1,341,602 | 5/1920 | Swenson | 70/312 X |
| 1,503,043 | .7/1924 | Greer | 70/287 X |
| 2,856,765 | 10/1958 | Sreb | 70/323 X |

FOREIGN PATENTS OR APPLICATIONS

| | | | |
|---|---|---|---|
| 416,006 | 11/1946 | Italy | 70/309 |
| 127,098 | 5/1919 | United Kingdom | 70/293 |

*Primary Examiner*—Robert L. Wolfe
*Attorney, Agent, or Firm*—Jenkins, Hanley & Coffey

[57] ABSTRACT

A locking mechanism in which a series of disks each having a radial hole therein are mounted on the inside of a door. Said disks are connected to dials on the outside of the door which are associated with numbered indicia and rotatable to vary the rotatable and axial positions of the holes in the disks. A locking bolt is slidably mounted on the inside of the door and interconnected to a series of pins which are receivable in the holes in said disks when said holes are aligned therewith. A lever is connected to the locking bolt and operable from outside the door to slidably move the bolt from a locked position to an unlocked position when the dials are set at preselected numbers on the indicia to rotatably align the holes in said disks for reception of the pins.

7 Claims, 11 Drawing Figures

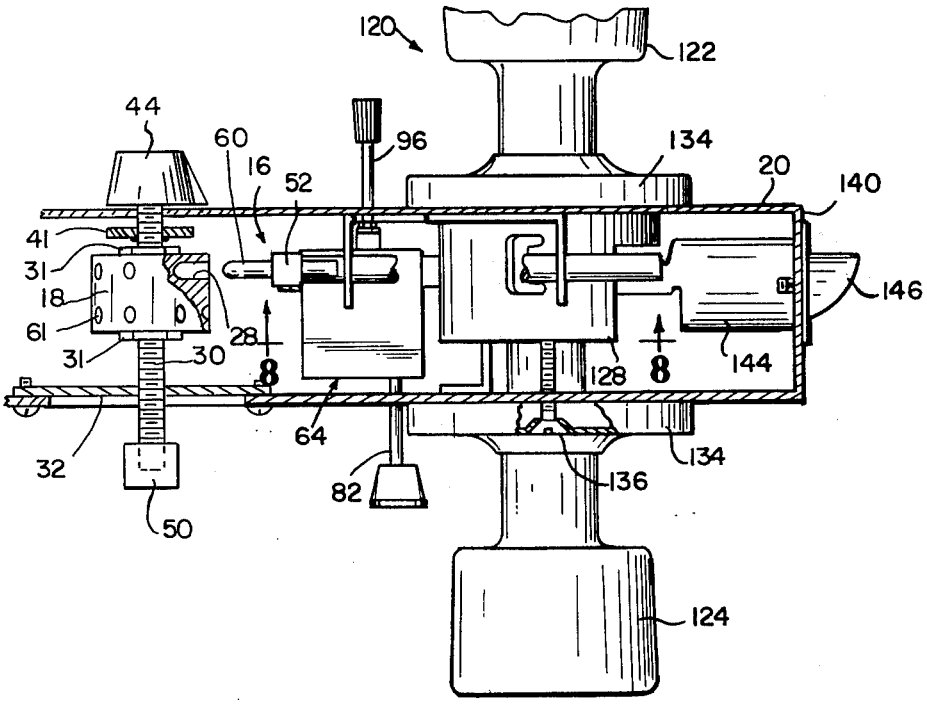
Fig. 7
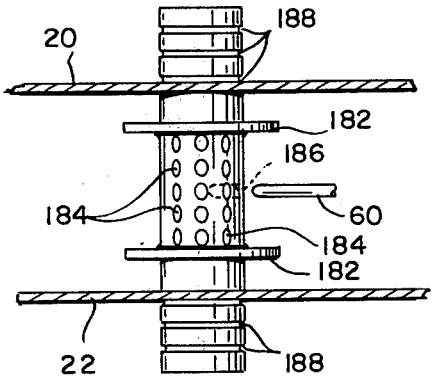
Fig. 8
Fig. 11
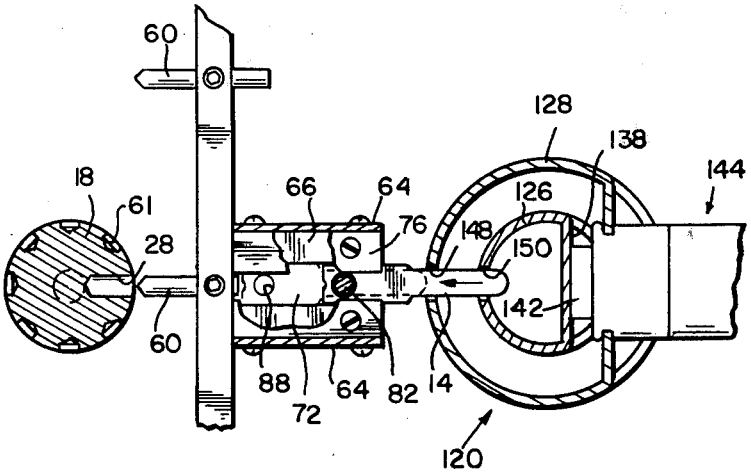

LOCKING MECHANISM

This is a continuation-in-part of copending application Ser. No. 494,080, filed Aug. 2, 1974, now abandoned.

BACKGROUND OF THE INVENTION

This invention relates to locking mechanisms for locking doors, windows, etc. More specifically, this invention relates to keyless locking devices wherein the device is unlocked by setting a plurality of rotatable dials to a preselected unlocking combination.

A wide variety of keyless locking devices are available throughout the prior art. Many of these keyless devices are of the type having a locking bolt interconnected to a plurality of fingers which are receivable simultaneously into holes formed in a plurality of rotatable disks when said disks are rotatably set according to a predetermined unlocking combination. See, for example, U.S. Pat. Nos. 843,869; 1,577,398; and 1,657,650. For this purpose, dials or the like are typically mounted in a position accessible from the outside of the locked member, such as a door, and are associated with numbered indicia. Rotation of the dials to the predetermined combination sequence rotates the disks to align the holes therein with said fingers and thereby allow retraction of the locking bolt to unlock the door.

Keyless locks of the type described above are intended to provide some protection against detection of the unlocking combination since a relatively large number of different unlocking combinations are possible. However, most prior art devices have no means by which to disguise the location of the holes in the disks. That is, one skilled at picking locks can still determine the unlocking combination by careful movement of the locking fingers against the disks, and corresponding careful rotation of the disks. To prevent this, some prior art devices have provided shallow recesses on each disk to provide false indication of the correct location of the hole therein. These recesses are not wholly satisfactory, however, in preventing the skilled individual from carefully moving the fingers against the disks as the disks are rotated to determine the unlocking combination of the mechanism.

Another disadvantage of most prior art keyless, combination locking devices is that the plurality of rotatable disks are usually mounted for rotation in a single plane. Thus, the possible number of combinations, only one of which is the true unlocking combination, is limited by the number of disks and the number of indicia positions for each disk. Therefore, with these prior art devices, it has not been heretofore possible to provide a locking device with a substantially unlimited number of possible combinations.

It is therefore desirable to provide a locking mechanism of the general variety described above which is reltatively simple in construction, yet provides means for disguising the locations of the holes in the disks. Further, it is desirable to provide such a locking mechanism having disks which are movable through a number of planar positions, and thereby provide a locking mechanism having a substantially unlimited number of possible unlocking combinations.

SUMMARY OF THE INVENTION

In accordance with the invention, a locking mechanism is provided for releasably locking closure apparatus, such as a door. The mechanism, in the preferred embodiment, comprises a plurality of rotatable disks mounted in a common plane in a position inaccessible from the outside of the door. The disks each have one radial passage formed therein and are interconnected to dials on the outside of the door which are rotatable with respect to radial indicia to vary the rotational and axial positions of the passages in the disks. If desired, the disks each have a plurality of shallow recesses formed therein to disguise the axial and rotation positions of their radial passage, and said recesses and radial passage are each closed by spring loaded inserts to further disguise the locations of said radial passage.

A carriage assembly having a locking bolt projecting outwardly therefrom is slidably mounted in a position inaccessible from the outside of the door and adjacent the disks. Said assembly has a plurality of pins mounted thereon which are slidably receivable into the passages in the disks when said passages are rotatably aligned therewith. The indicia sequence indicated by the dials when the passages in the disks are so aligned thus comprises a combination for unlocking the door.

A lever is connected to the carriage and extends through the door to the outside thereof. The lever is operable from outside the door to slidably move the carriage between a locking position with the pins retracted from the passages in the disks and the locking bolt disposed to prevent opening of the door, and an unlocked position with the pins received in the holes in the disks and the locking bolt disposed to permit opening of the door. When the disks are not axially and rotationally aligned for reception of the pins, the disks block movement of the carriage assembly to an unlocked position and thereby prevent opening of the door.

BRIEF DESCRIPTION OF THE DRAWINGS

The accompanying drawings illustrate the invention. In such drawings:

FIG. 7 is a fragmentary horizontal section of a door having a door knob assembly mounted thereon and modified for use with a locking mechanism of this invention;

FIG. 8 is a fragmentary vertical section taken on the line 8—8 of FIG. 7, with portions thereof broken away;

FIG. 11 is a fragmentary plan view of another modified disk assembly.

DETAILED DESCRIPTION OF THE PREFERRED EMBODIMENT

Figure 1:
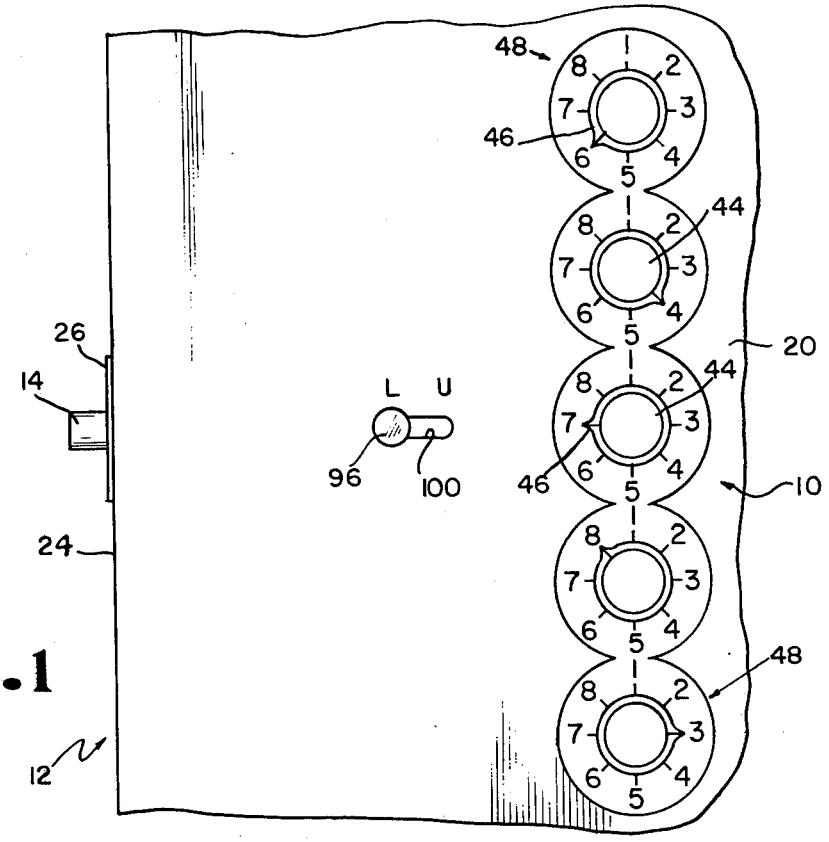
FIG. 1 is a fragmentary front elevation view of the outside of a door having a locking mechanism of this invention mounted thereon, and showing said mechanism in a locked position.

A locking mechanism 10 embodying a preferred form of the invention is illustrated in FIGS. 1–6. As shown, the locking mechanism 10 is mounted on a door 12, and generally comprises a locking bolt 14 mounted on a movable carriage assembly 16. A plurality of disk assemblies each have a disk 18 rotatable from outside the door, and when said disks 18 are oriented in predetermined positions, the carriage assembly 16 is movable to retract the locking bolt to unlock the door.

Figure 2:
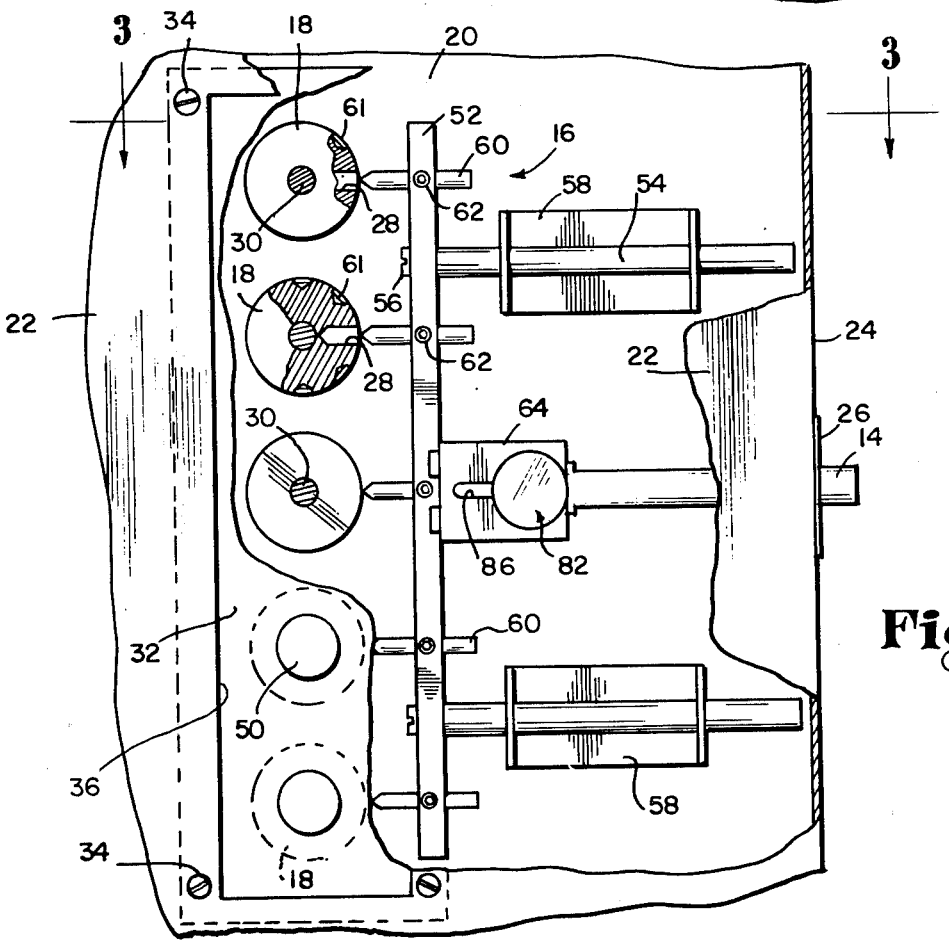
FIG. 2 is a fragmentary rear elevation view of the inside of the door shown in FIG. 1, with portions thereof broken away.
Figure 3:
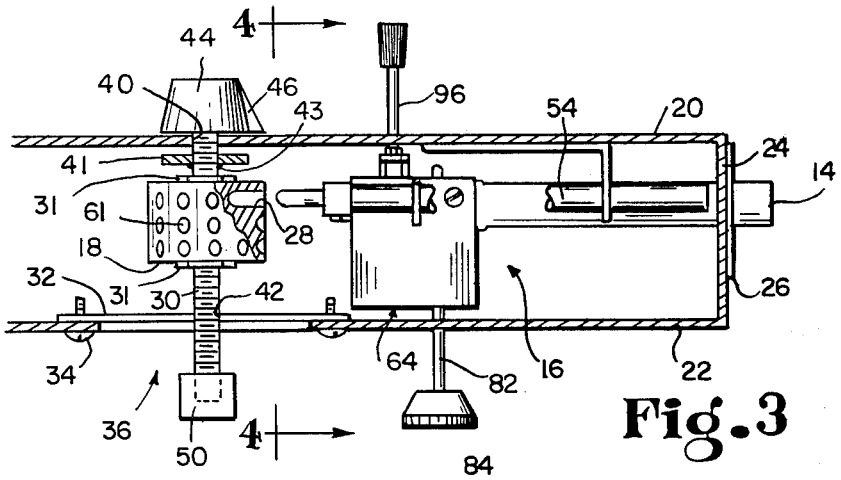
FIG. 3 is a horizontal section taken on the line 3—3 of FIG. 2, with portions thereof broken away.

As shown in FIGS. 1–3, the locking mechanism 10 is mounted on the door 12 generally between the outside door panel 20 and the inside door panel 22. The locking bolt 14 on the carriage assembly 16 extends outwardly, when in a locked position, through the door side panel 24 for reception in a locking recess in an adjacent doorjamb (not shown) to prevent opening of the door. Conveniently, a metal guide 26 is mounted on the door side panel 24 to minimize wear due to the sliding action of the locking bolt.

A series of five cylindrical disks 18 are mounted in vertically spaced relation between the outside and inside door panels 20 and 22. Said disks are identical in construction, and each has one radial hole 28 formed therein which has a depth slightly less than the radius of the disk. As shown, each of said disks is received about a horizontally extending threaded shaft 30, and is fixed in position thereon by a pair of lock nuts 31. The shaft 30 has one end rotatably received through an appropriately formed hole 40 in the outside door panel 20, and its other end threadably received through an aligned hole 42 in a mounting plate 32. If desired, the hole 40 in the outside panel can also be threaded. The mounting plate is fastened to the inside door panel 22 by screws 34, and serves to close an access opening 36 in the panel 32. The access opening is desirably provided to facilitate mounting of the mechanism between the door panels.

Each of the threaded shafts 30 extends outwardly through the outside panel 20 of the door for connection to a dial 44 having a radial pointer 46, as shown in FIGS. 1 and 3. The dials 44 are each associated with radially arranged indicia 48 on the outer surface of the door, such as the numbers one through eight as shown, and said dials are each rotatable with respect to the indicia to selectively rotate the threaded shaft 30 connected thereto. Such rotation serves to rotatably move the disk 18 connected to the shaft 30 as well as to move the disk axially along the shaft axis. Each shaft 30 also extends outwardly from the mounting plate 32 on the inside of the door for reception in a knob 50. The knobs 50 are rotatable from the inside of the door to also vary the rotational and axial positions of the disks 18 interconnected thereto. Thus, the rotational and axial position of the radial hole 28 in each of the disks is variable by manual rotation of either the dial 44 or the knob 50 associated therewith.

As shown best in FIG. 3, each of the threaded shafts 30 has a washer-like stop 41 fixed thereabout as by welds 43 between the disk 18 and the outside door panel 20. With the stops, each dial 44 is rotatable in one direction until the stop 41 associated therewith engages the outside door panel 20, and in the opposite direction until the dial 44 abuts the door panel 20. As will hereafter become more apparent, the disk assembly is in a reference position when the stop 41 is in engagement with the door panel 20. Conveniently, the disks 18 and the inside knobs 50 are each spaced a sufficient distance from the mounting bracket 32 so as to not interfere with the engagement of the outside panel 20 by the stops 41 or the dials 44.

The cylindrical disks 18 are fixed in different positions along the lengths of their respective shafts 30. That is, when the radial holes 28 in the disks 18 are oriented in identical rotational and axial positions, the stops 41 on the shafts will each be disposed at random distances from their reference positions in engagement with the door panel 20, and the pointers 46 on the dials will indicate from top to bottom a random sequence of numbers on the indicia 48. For reasons which will hereafter become more apparent, the disks 18 are oriented to permit retraction of the locking bolt 14 when the radial holes 28 in the disks are rotationally and axially oriented in a common vertical plane and extending horizontally in mutually parallel positions opening toward the door side panel 24, as shown in FIG. 2, for simultaneous reception of a plurality of pins 60 on the carriage assembly 16. Thus, the number of revolutions each dial must be turned from the reference position together with the final sequence of numbers indicated by the pointers 46 when all of the radial holes 28 are properly aligned for reception of the pins comprises a combination for unlocking the door. Conveniently, the rotational and axial position of each disk is periodically changeable by loosening the lock nuts 31 and altering the position of each disk along the length of its threaded shaft 30. Further, the dials 44 are preferably connected to their respective shafts 30 by set screws (not shown) to permit changing of their rotational positions with respect to their associated disks 18.

The carriage assembly 16 comprises a vertically extending bar 52 which is slidably mounted between the outside and inside door panels 20 and 22. The bar 52 is connected to a pair of horizontally extending rods 54 as by screws 56, and said rods 54 are each slidably carried in tracks formed by aligned holes in the arms of a pair of U-shaped guides 58. The guides are mounted as by welding on the inner surface of the outside door panel 20. Alternatively, said guides 58 can be mounted by screws or the like on the inside door panel 22 when said door panels are formed from wood or other nonmetallic materials.

The pins 60 referred to above are received through vertically spaced holes in the bar 52 and are fastened in horizontally extending positions by set screws 62. Said pins 60 are carried by the bar in a common vertical plane, with each of said pins being disposed adjacent one of the disks 18. The pins 60 each have a size and shape for slidable reception into the radial hole 28 in the adjacent disk when said hole 28 is rotationally and axially aligned therewith. And all of the disks have their holes 28 aligned for reception of the associated pins 60 when the dials 44 connected to said disks are axially and rotationally set according to the combination sequence for unlocking the door.

The carriage assembly 16 also comprises a generally U-shaped bracket 64 interconnected to the vertically extending bar 52 at the center thereof and on the side presented toward the door side panel 24. As shown best in FIGS. 4 and 5, the bracket 64 is connected to a pair of parallel lengths 66 of metal stock as by screws 68. The parallel lengths are disposed on the inside faces of the U-shaped bracket 64 near the open end thereof, and are in turn fastened in end-abutting relation to the bar 52 as by screws 70. An end plate 72 closes the open end of the bracket 64 and is fastened to the adjacent metal lengths 66 by screws 74. A pair of guide plates 76 are mounted parallel to each other as by screws 78 on the metal lengths 66 opposite the end plate 72. As shown, the guide plates 76 have a width slightly greater than the width of the metal lengths 66 to define a horizontally extending track for slidable reception of the locking bolt 14.

Figure 4:
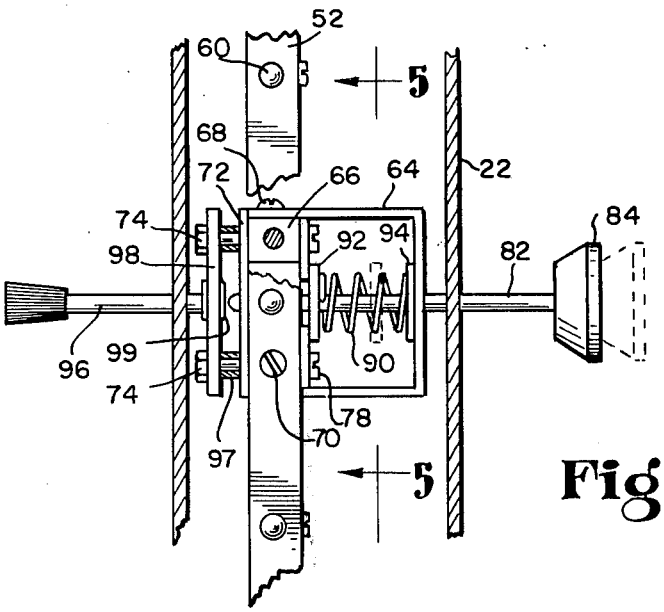
FIG. 4 is an enlarged vertical section taken on the line 4—4 of FIG. 2, with portions thereof broken away.
Figure 5:
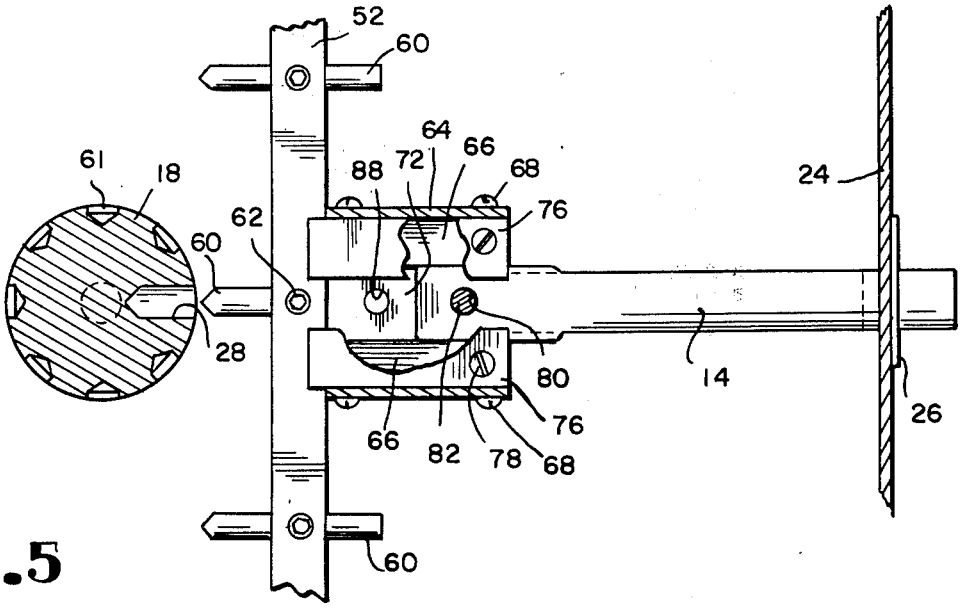
FIG. 5 is a fragmentary vertical section taken on the line 5—5 of FIG. 4, with portions thereof broken away.

The locking bolt 14 has a hole 80 formed therethrough for passage of the end of a lock set pin 82. The pin 82, as shown in FIGS. 4 and 5, has a knob 84 at one end and extends through a horizontally extending slot 86 in the closed end of the bracket 64, and through the hole 80 in the locking bolt 14 for reception in one pair of spaced-apart holes 88 formed in the track end plate 72. A spring 90 is retained in a partially compressed state about the pin 82 between a fixed flange 92 adjacent the locking bolt 14 and a slidable washer 94 at the closed end of the bracket 64. Said spring 90 serves to secure the end of the pin 82 in the selected hole 88 in the end plate 72, and thereby fix the position of the locking bolt 14 within its track.

The position of the lock set pin 82 is adjustable from the inside of the door to move the locking bolt 14 between an operative and inoperative position. For example, when the lock set pin 82 is received in the right-hand hole 88 in the end plate 72, as shown in FIG. 5, and the pins 60 on the bar 52 are not received in the holes 28 in the disks, the locking bolt 14 is secured in an operative position projecting outwardly through the door side panel 24. However, when the lock set pin is received in the left-hand hole 88 of the end plate as shown in dotted lines in FIG. 5, the bolt 14 is retracted to an inoperative position. In this position, the locking bolt does not extend outwardly through the door side panel and thus permits the door to be opened. Movement of the lock set pin 82 from one position to another is accomplished by manually retracting the set pin 82 to the dotted line position shown in FIG. 4 to allow the end of the pin to clear the hole 88. The locking bolt 14 can then be moved within the track from one position to another by sliding said bolt with the end of the set pin 82, and then allowing the spring 90 to carry the end of the pin into the other hole 88.

A lock release lever 96 is also connected to the carriage assembly 16. As shown in FIGS. 3 and 4, the heads of the pair of screws 74 are spaced from the end plate 72 by spacers 97, and a bridge 98 is retained between said spacers 97 and the heads of said screws. The release lever 96 is connected to said bridge 98 as by a screw 99, and extends therefrom through a horizontally extending slot 100 (FIG. 1) in the outside door panel 20.

When the locking bolt 14 is set within the carriage track by the lock set pin 82 in an operative position, as shown in FIG. 5, the lock release lever 96 is operable from outside the door to move the entire carriage assembly between a locked position and unlocked position. For example, the carriage assembly is placed in a locked position by moving the release lever 96 within the slot 100 to a position nearest the door side panel 24, and conveniently designated by the letter L on the outside door panel. This carries the locking bolt 14 into a locking recess in an adjacent doorjamb (not shown) to lock the door.

Figure 6:
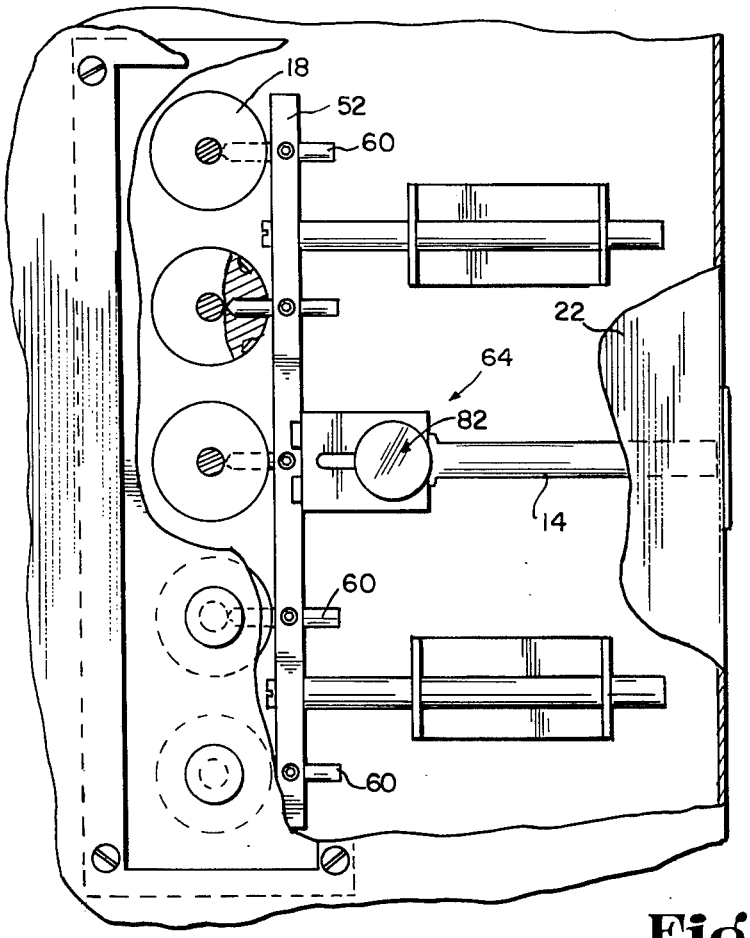
FIG. 6 is a fragmentary rear elevation view similar to FIG. 2, but showing the mechanism in an unlocked position.

When it is desired to unlock the door from the outside, the rotatable dials 44 are first rotated to their reference positions with their associated stops 41 engaging the door panel 20. Then, the dials are rotated a predetermined number of revolutions and are set to the desired number on the indicia 48 in accordance with the combination sequence for unlocking the door. When all of the dials are appropriately set, the holes 28 in the disks 18 are axially and rotatably aligned for reception of their respective pins 60. With the holes 28 so aligned, the lock release lever 96 is thrown to the right as viewed in FIG. 1 to the unlocked position designated by the letter U on the door. This carries the entire carriage assembly 16 to the left as viewed in FIG. 2 to an unlocked position as shown in FIG. 6. As shown, all of the pins 60 are received in the holes 28 in their respective disks 18. Such reception of the pins 60 in the disks permits sufficient travel of the carriage assembly to retract the locking bolt 14 from the adjacent doorjamb, and to thus permit the door to be opened. Importantly, when one or more of the dials is not set according to the unlocking combination number sequence, the hole 28 in the associated disk 18 is not aligned for reception of the adjacent pin 60. In that event, movement of the carriage assembly causes the adjacent pin 60 to strike and stop against the outer diameter of the unaligned disk 18 and thereby prevent any of the other pins from being received in the hole in their adjacent disks. Thus, with one of the disks not set according to the unlocking combination, the entire carriage assembly cannot be moved a sufficient distance to the left as viewed in FIG. 2 to retract the locking bolt from the adjacent doorjamb.

After the door has been unlocked from the outside as described above, it is often desirable to relock the door from the inside. To this end, the carriage assembly is movable by pushing the lock set lever 82 to the right as viewed in FIG. 6 to retract the pins 60 from their respective holes 28 in the disks 18. This moves the locking bolt 14 back into the locking recess in the doorjamb to prevent opening of the door. Then, the door is relocked by rotating any number of the knobs 50 on the inside mounting plate 32 to randomly scramble the axial rotational positions of the radial holes 28 in the disks 18. Such scrambling prevents reinsertion of the pins 60 into the disk holes 28 to relock the door until the dials 44 are reset according to the combination number sequence. Alternately, the knobs 50 can be rotated to move the disks back to their reference positions with their stops 41 engaging the outside door panel.

Conveniently, to help prevent detection of the unlocking combination sequence, shallow recesses 61 are formed about the outer surface of each of the disks 18. These recesses are associated with the indicia positions other than the unlocking combination positions to serve as false indication of the true location of the radial holes 28. As shown, the shallow recesses are formed in a ringed pattern about the periphery of each disk 18. Alternately, the recesses can be formed in a spiraled pattern so that one of the recesses or the radial hole 28 is associated with each numbered position on the indicia through two or more revolutions of each dial 44. Still further, instead of shallow recesses, almost any convenient irregularity on the outer surface of each disk will serve to help disguise the location of the radial hole therein.

While the locking mechanism has been shown and described above as providing a dead bolt for a door, said mechanism can be utilized in conjunction with a door knob assembly to selectively prevent rotation of the door knobs, and thereby selectively lock the door. Such a modification is shown in FIGS. 7 and 8. As shown, a door knob assembly 120, which is representative of most conventional door knob assemblies, comprises outside and inside rotatable door knobs 122 and 124, respectively, which are interconnected by a knob sleeve 126 extending through the door. The sleeve 126 is rotatably carried within a generally cylindrical-shaped knob casing 128 mounted between the outside panel 20 of the door and the inside panel 22 by escutcheons 134 and a screw 136. Within the casing 128, the sleeve 126 has a flattened face 138 presented toward the door side panel 140, and said face 138 is engageable upon rotation of either of the knobs 122 or 124 with a retracting pin 142 of a latch bolt assembly 144. The retracting pin 142 is connected within the bolt assembly 144 in a conventional manner to a door latch bolt 146 which is releasably received in a locking recess in an adjacent doorjamb (not shown) to prevent opening of the door. The pin 142 is operative when engaged by the face 138 of the knob sleeve to retract said latch bolt from its normally closed position as shown to permit the door to be opened. Conveniently, a spring, which is not shown in the drawings for purposes of clarity, is connected between the knob casing 128 and the knob sleeve 126 to automatically return said sleeve and the door knobs 122 and 124 to their original position after rotation thereof.

The locking mechanism 10 is mounted between the outside and inside door panels 130 and 132 in a manner similar to that shown in FIGS. 1–6. As shown in FIG. 8, the locking bolt 14 is receivable through aligned holes 148 and 150 in the knob casing 128 and knob sleeve 126 to prevent rotation of the knob sleeve, and thus lock the door. The locking bolt 14 is movable, as described above, between an operative position and an inoperative position by adjusting the location of the bolt 14 within the carriage track by means of the lock set pin 82. Also, when the bolt 14 is in an operative position, the carriage assembly is movable between a locked position with the bolt received through the holes 148 and 150 in the knob casing and sleeve, and an unlocked position with all of the pins 60 received in the radial holes 28 in the disks 18. As before, the pins 60 are receivable in the radial holes 28 only when the dials 44 on the outside of the door are set to the unlocking combination sequence to rotationally and axially align the disk holes 28 with said pins.

Figure 9:
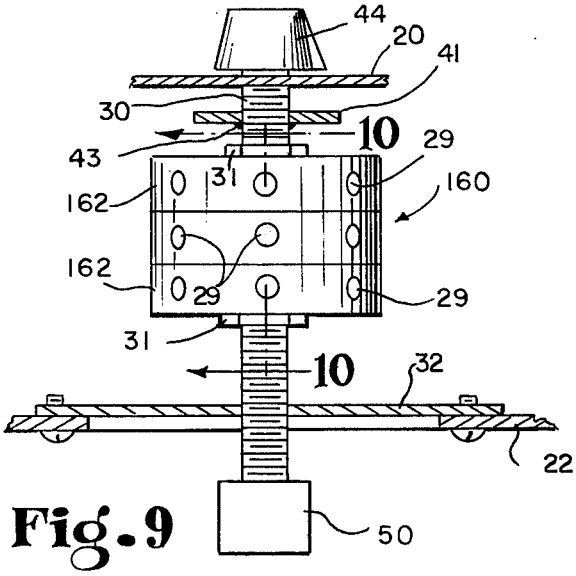
FIG. 9 is an enlarged plan view of a modified disk assembly for use in a locking mechanism of this invention.
Figure 10:
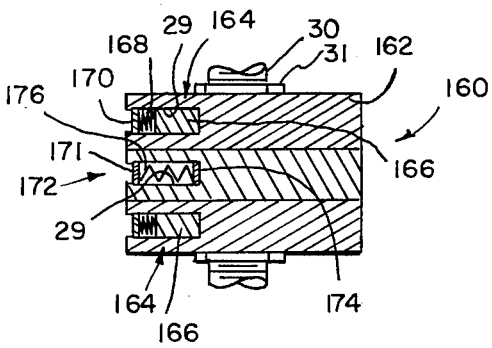
FIG. 10 is a fragmentary vertical section taken on the line 10—10 of FIG. 9.

A further modification of the locking mechanism of this invention is shown by way of example in FIGS. 9 and 10. In this modification, the locking mechanism is similar to that shown in FIGS. 1–6, with the exception of the rotatable disk assemblies. Accordingly, since all of the modified disk assemblies in this modification are identical, only one of such assemblies is shown and described. As shown, the modified assembly has a cylindrical disk 160 formed from three sections 162 which are received about the threaded shaft 30 and abuttingly retained in the desired rotational and axial positions by the lock nuts 31. Each of the sections 162 has a series of radial holes 29 formed therein, and each of said holes is of a sufficient depth to receive an adjacent pin 60 on the carriage assembly previously described to permit the carriage to be moved to an unlocked position. However, as shown in FIG. 10, all but one of the holes 29 has an insert 164 mounted therein, and this insert 164 comprises a cylindrical plug 166 fixed as by any suitable adhesive to the base of the holes 29. The plug 166 substantially fills the hole 29, and has a short spring 168 suitably fastened thereto and to a cover 170. The cover 170 is disposed substantially flush with the outer diameter of the disk 160, and closes the opening 29. The remaining hole 29, shown in the central section 162 in FIG. 10, has a different insert 172 received therein. This insert 172 has a thin base 174 fixed as by the adhesive to the bottom of the hole 29, and a relatively tall spring 176 is suitably interconnected between the base and a cover 171 disposed flush with the disk outer diameter.

In the modification of FIGS. 9 and 10, each of the three part disks 160 thereby has only one hole 29 for receiving an adjacent pin 60 on the carriage assembly to permit the assembly to move the locking bolt to an unlocked position. The remaining holes 29 with the inserts 164 only partially receive the pins 60, and thereby serve to give false indication of the unlocking combination of the mechanism. That is, each of the holes 29 in the three part disk 160 has one of the spring-loaded inserts therein to thus react in a substantially identical manner to reception of a pin 60. Accordingly, the spring-loaded inserts 164 and 172 serve to make detection of the correct unlocking combination sequence almost impossible.

The modification of FIGS. 9 and 10 is also advantageous in that the disk 160 can be adjusted to meet almost any desired unlocking combination sequence. For example, the three disk sections 162 can be altered rotationally with respect to their associated dial 44, or with respect to each other, by loosening the lock nuts 31 and rearranging the rotational positions of the sections. Further, the axial positions of the sections 162 with respect to each other can be altered by removing the sections from the shaft and then returning them to the shaft in a different order.

The locking mechanism of this invention thus provides a versatile, keyless mechanism for locking doors, windows, or the like. The mechanism is simple in construction, and inexpensive to manufacture. The individual disks are each movable axially and rotationally to thus provide an almost unlimited number of possible disk positions, and thereby also provide an almost unlimited number of possible combination sequences. Further, while disks mounted on a threaded shaft for simultaneous axial and rotational movement have been shown and described, it is to be understood that said disks can be mounted for independent axial and rotational movement. For example, as shown in FIG. 11 of the drawings, the threaded shaft 30 of each disk assembly can be replaced by a smooth-surfaced shaft 180 which slides easily along its own axis and has stops 182 fixed thereon to prevent unwanted removal from the outside of the door. The smooth shaft 180 has radial indicia printed on the opposed ends thereof, and is thus rotatable about its own axis according to said indicia. Such rotation serves to alter the radial positions of a plurality of shallow recesses 184 as well as a radial hole 186. Axial measurement markings such as recessed rings 188 are also formed at each end of the smooth shaft to indicate the distance the shaft extends outwardly from the door. These axially spaced rings 188 can be, if desired, marked with different colors to distinguish between them. With this construction, each shaft 180 is independently set rotationally and axially at the desired rotational and axial positions to permit reception of a pin 60 to thereby permit the door to be unlocked and opened.

While the locking mechanism has been above shown and described as mounted on a door between the outside and inside door panels, the disk and carriage assemblies of the mechanism need only be mounted at a convenient location inside the outer door panel with its rotatable dials and lock release lever accessible from the outside. Moreover, the mechanism can be mounted on the door or on the doorjamb adjacent thereto. The mechanism can be installed on a door or any other closure device as the device is being manufactured, or at a later time after the device is placed into service. Furthermore, while the series of disks and pins, etc. have all been described as being disposed in a common vertical plane, said disks and pins need not necessarily be oriented in any particular common horizontal or vertical plane.

I claim:

1. A locking mechanism for releasably locking closure apparatus, comprising a plurality of shafts each mounted for rotation about its own axis and for axial movement along its own axis, said shafts each having one end accessible from the outside of the apparatus and a portion inaccessible from the outside of the apparatus; a plurality of disk members each having a radial passage formed therein and mounted on the inaccessible portion of said shafts for rotational and axial movement therewith, each of said disk members having a plurality of disk sections with each of said disk sections having a plurality of radially open shallow recesses and one of said sections having said radial passage formed therein, and means for releasably retaining said sections together in a predetermined rotational and axial relation; dial means connected to the accessible end of each of said shafts and associated with radial indicia and axial indicating means to allow selective rotational and axial positioning of the passages in said disk members; a carriage slidably mounted adjacent said disk members and inaccessible from the outside of the apparatus; a plurality of pins mounted on said carriage and slidably receivable simultaneously into the passages in said disk members when said passages are rotationally and axially aligned therewith; a locking bolt carried on said carriage; and lever means connected to said carriage and operable from the outside of the apparatus to slidably move the carriage between a locked position with said bolt disposed to lock said apparatus and an unlocked position with said pins each received in the radial passage in one of said disk members.

2. A locking mechanism as set forth in claim 1 with the addition of knob means accessible from the inside of the apparatus and connected to the ends of said shafts opposite said dial means.

3. A locking mechanism as set forth in claim 1 wherein each of said shafts is threaded, said shafts each being mounted for simultaneous axial and rotational movement.

4. A locking mechanism as set forth in claim 1 wherein each of said disk members has a plurality of radial passages formed therein, and further comprising a first insert mounted in one of said passages and a second insert mounted in each of the remaining passages, said first and second inserts each being spring-loaded and having a cover disposed substantially flush with the surface of said disk member for substantially closing the respective passages, said first insert being depressable within its passage upon contact with one of the pins on said carriage to permit reception of said pin in that passage and thereby permit movement of said carriage to an unlocked position, said second inserts being depressable within their respective passages upon contact with one of the pins to permit only partial reception of the pin to thereby form said radially open shallow recesses and to disguise the location of the passage having said first insert therein.

5. A locking mechanism as set forth in claim 1 wherein said locking bolt is slidably received in a track formed on said carriage, and with the addition of second lever means connected to said bolt and operable from the inside of the apparatus for slidably moving said bolt within the track formed on said carriage between an inoperative position with said bolt inoperatively disposed to lock the apparatus, and an operative position with said bolt disposed to lock the apparatus when said carriage is in a locked position and to place the apparatus in an unlocked condition when said carriage is in an unlocked position.

6. A locking mechanism as set forth in claim 1 wherein the apparatus comprises a door provided with a door knob assembly having inside and outside rotatable door knobs interconnected by a knob sleeve and operatively associated with a latch bolt to retract said latch bolt upon rotation of the knobs to permit opening of the door, said locking bolt being slidably received in a hole formed in said knob sleeve when said carriage is in a locked position to prevent rotation of said knobs and knob sleeve and thereby prevent opening of the door, said locking bolt being retracted from the hole in said knob sleeve when said carriage is in an unlocked position to permit rotation of said knobs and knob sleeve and thereby permit opening of the door.

7. A locking mechanism for releasably locking closure apparatus, comprising a plurality of shafts each mounted for rotation about its own axis and for axial movement along its own axis, said shafts each having one end accessible from the outside of the apparatus and a portion inaccessible from the outside of the apparatus; a plurality of disk members each having a radial passage formed therein and mounted on the inaccessible portion of said shafts for rotational and axial movement therewith, each of said disk members having a plurality of disk sections with one of said sections having said radial passage formed therein, and means for releasably retaining said sections together in a predetermined rotational and axial rotation; dial means connected to the accessible end of each of said shafts and associated with radial and axial indicia to allow selective rotational and axial positioning of the passages in said disk members; a carriage slidably mounted adjacent said disk members and inaccessible from the outside of the apparatus; a plurality of pins mounted on said carriage and slidably receivable simultaneously into the passages in said disk members when said passages are rotationally and axially aligned therewith; a locking bolt carried on said carriages; and lever means connected to said carriage and operable from the outside of the apparatus to slidably move the carriage between a locked position with said bolt disposed to lock said apparatus and an unlocked position with said pins each received in the radial passage in one of said disk members.

* * * * *